US005549847A

United States Patent [19]

Goliro et al.

[11] Patent Number: 5,549,847

[45] Date of Patent: Aug. 27, 1996

[54] FLOWABLE AQUEOUS DISPERSIONS OF POLYCARBOXYLIC ACID CORROSION INHIBITORS

[75] Inventors: Martine Goliro, St-Louis-La Chaussée, France; Martin Holer, Magden; Sandor Gati, Allschwil, both of Switzerland

[73] Assignee: Ciba-Geigy Corporation, Tarrytown, N.Y.

[21] Appl. No.: 345,013

[22] Filed: Nov. 23, 1994

Related U.S. Application Data

[63] Continuation of Ser. No. 870,651, Apr. 20, 1992, abandoned.

[30] Foreign Application Priority Data

Apr. 24, 1991 [CH] Switzerland ..... 1228/91

[51] Int. Cl.[6] ..... C23F 11/14

[52] U.S. Cl. ..... 252/394; 422/16; 252/311

[58] Field of Search ..... 252/394, 395, 252/391, 392, 390, 79, 311; 544/205, 206, 207, 212, 196, 197, 198; 106/14.15, 14.18; 422/16, 17; 210/698

[56] References Cited

U.S. PATENT DOCUMENTS

| | | | |
|---|---|---|---|
| 2,767,144 | 10/1956 | Gottshall | 252/396 |
| 2,775,560 | 12/1956 | Lurton et al. | 252/396 |
| 2,929,696 | 5/1960 | Barusch et al. | 252/396 |
| 3,334,048 | 8/1967 | Hitchcock et al. | 252/77 |
| 3,578,589 | 5/1971 | Hwa et al. | 252/389.1 X |
| 3,697,520 | 10/1972 | Winter | 544/196 |
| 3,720,615 | 3/1973 | Izumi et al. | 252/396 |
| 3,992,343 | 11/1976 | Haschke et al. | 524/556 |
| 4,105,405 | 8/1978 | Wehle et al. | 252/396 |
| 4,108,790 | 8/1978 | Foroulis | 252/396 |
| 4,132,850 | 1/1979 | Conrow et al. | 544/196 |
| 4,402,907 | 9/1983 | Clark | 422/7 |
| 4,409,113 | 10/1993 | Bertell | 252/42 |
| 4,569,939 | 2/1986 | Esanu | 514/302 |
| 4,869,841 | 9/1989 | Mattesdo | 252/396 |

FOREIGN PATENT DOCUMENTS

| | | |
|---|---|---|
| 1225404 | 8/1987 | Canada . |
| 0129506 | 12/1984 | European Pat. Off. . |
| 0201958 | 11/1986 | European Pat. Off. . |
| 3142059 | 5/1983 | Germany . |

OTHER PUBLICATIONS

Chemical Abstract, vol. 94, No. 6, (1981) Abstract No. 35219w.

Derwent Abstract 44404 K/19 May 5, 1983.

Chemical Abstract 99:39971m May 5, 1983.

*Primary Examiner*—Sharon Gibson

*Assistant Examiner*—Valerie Fee

*Attorney, Agent, or Firm*—William A. Teoli, Jr.; David R. Crichton

[57] ABSTRACT

Highly concentrated flowable dispersions of corrosion inhibitors can be prepared by stirring a filter cake of the corrosion inhibitor with a dispersant and a thickener. These dispersions are storage stable.

13 Claims, No Drawings

FLOWABLE AQUEOUS DISPERSIONS OF POLYCARBOXYLIC ACID CORROSION INHIBITORS

This application is a continuation of application Ser. No. 07/870,651, filed Apr. 20, 1992 now abandoned.

The present invention relates to flowable, highly concentrated aqueous dispersions of polycarboxylic acid corrosion inhibitors and to a special process for their preparation.

It is known that specific polycarboxylic acids are very suitable corrosion inhibitors for aqueous systems in contact with metals, inter alia the heterocyclic polycarboxylic acids disclosed in U.S. Pat. No. 4,402,907 or EP-A-129 506. Aqueous systems in contact with metals include cooling water systems, steam generating plants, aqueous machining fluids or aqueous hydraulic fluids. As most polycarboxylic acids have only limited solubility in water, the polycarboxylic acids are used in the form of their water-soluble salts, i.e. they are neutralised prior to use or they are added to a basic aqueous system. However, storage and commercial forms are normally the free polycarboxylic acids.

The free polycarboxylic acids are normally solids. In their synthesis they are usually isolated from an aqueous phase by filtration. The filter product is customarily washed with water and then dried. To save on the energy required for drying, the recent trend has been to provide the moist filter cake containing about 50 % of water as commercial form for use in aqueous systems.

The drawback of the moist filter cake is, however, that it is not flowable. It cannot be added by tipping or pouring, but is added manually, for example by shovelling.

It has now been found that highly concentrated dispersions of such solid polycarboxylic acid corrosion inhibitors can be prepared from the moist filter cake by a special process. These dispersions are flowable and can therefore be transported in the containers normally used for liquids and added by conventional metering devices. The dispersions so obtained keep these physical properties over periods of several months, i.e. they have no tendency to dehomogenise or solidify.

Specifically, the invention relates to flowable aqueous dispersions of a solid polycarboxylic acid corrosion inhibitor comprising 25–57% by weight of the corrosion inhibitor, 40–72% by weight of water, 0.1–2% by weight of a dispersant and 0.01 to 0.5% by weight of a thickener.

Preferred dispersions comprise 40–53% by weight of a compound of formula I, II or III, 45–58% by weight of water, 0.1 to 2% by weight of a dispersant and 0.01 to 0.5% by weight of a thickener.

The polycarboxylic acid corrosion inhibitors are preferably dicarboxylic or tricarboxylic acids of formula I, II or III

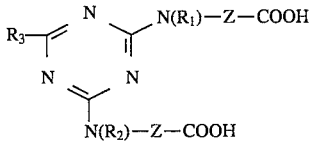

I

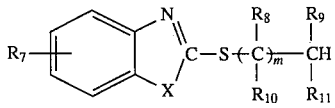

II $HOOC-(CH_2)_n-COOH$ III wherein

Z is $C_1$–$C_{11}$alkylene, cyclohexylene or phenylene, $R_1$ and $R_2$ are each independently of the other H, $C_1$–$C_4$alkyl or a group —Z—COOH, $R_3$ is $C_1$–$C_{12}$alkyl, phenyl or a group —N($R_4$)($R_5$), —O$R_6$ or —S$R_6$, $R_4$ and $R_5$ are each independently of the other H, $C_1$–$C_{12}$alkyl, $C_2$–$C_4$hydroxyalkyl, cyclohexyl, phenyl or a group —Z—COOH, or $R_4$ and $R_5$, when taken together, are $C_4$–$C_6$alkylene or 3-oxapentylene, $R_6$ is hydrogen, $C_1$–$C_{12}$alkyl or phenyl, m is 0 or 1, X is sulfur, oxygen or NH, $R_7$ is hydrogen, $C_1$–$C_4$alkyl, halogen, $C_1$–$C_4$alkoxy, carboxy, amino or nitro, $R_8$, $R_9$, $R_{10}$ and $R_{11}$ are each independently of one another hydrogen, $C_1$–$C_{12}$alkyl, $C_1$–$C_4$hydroxyalkyl, $C_2$–$C_6$carboxyalkyl, $C_2$–$C_{10}$alkoxyalkyl, carboxyl, phenyl or benzyl, or $R_8$ and $R_9$, when taken together, are a direct bond, with the proviso that at least two of the groups $R_8$, $R_9$, $R_{10}$ and $R_{11}$ are a carboxyl or carboxyalkyl group, and n is 2–10, and the alkali metal salts, ammonium salts or amine salts of such polycarboxylic acids.

If the dispersion contains salts of polycarboxylic acids, said salts may be partial or full salts. Particularly suitable alkali metal salts are sodium salts. Amine salts may be salts of primary, secondary or tertiary amines, typically salts of butylamine, octylamine, dodecylamine, tridecylamine, tetradecylamine, octadecylamine, diethylamine, dibutylamine, dihexylamine, dioctylamine, triethylamine, tributylamine, trihexylamine, cyclohexylamine, piperidine, morpholine, ethanolamine, propanolamine, di- or triethanolamine.

More particularly, the corrosion inhibitors are compounds of formula I, II or III, wherein Z is $C_1$–$C_8$alkylene, $R_1$ and $R_2$ are hydrogen or $C_1$–$C_4$alkyl, $R_3$ is a group —N($R_4$)($R_5$), $R_4$ is hydrogen, cyclohexyl or $C_1$–$C_{12}$alkyl, $R_5$ is $C_1$–$C_{12}$alkyl, phenyl or a group —Z—COOH, or $R_4$ and $R_5$, when taken together, are 1,5-pentylene or 3-oxa-1,5-pentylene, m is 0 or 1, X is sulfur, $R_7$ is hydrogen, methyl or chloro, and $R_8$ and $R_{10}$ are hydrogen, $R_9$ and $R_{11}$ are carboxyl or $C_2$–$C_4$carboxyalkyl and n is 4–8, and the alkali metal salts, ammonium salts or amine salts of such polycarboxylic acids.

It is especially advantageous to use corrosion inhibitors of formula I, H or HI, wherein Z is pentamethylene, $R_1$ and $R_2$ are hydrogen, $R_3$ is a group —NH—$(CH_2)_5$—COOH, X is sulfur, $R_7$ is hydrogen, m is 0 or 1, $R_8$ and $R_{10}$ are hydrogen, $R_9$ is carboxyl, $R_{10}$ is carboxymethyl and n is 8, or an alkali metal salt, ammonium salt or amine salt of such a polycarboxylic acid.

The compounds of formula I are disclosed as corrosion inhibitors for aqueous systems in U.S. Pat. No. 4,402,907. This patent also cites literature in which the preparation of these compounds is described.

Representative examples of compounds of formula I are: 2,4,6-tris(5'-carboxypentylamino)-1,3,5-triazine, 2,4,6-tris(carboxymethylamino)-1,3,5-triazine, 2,4,6-tris(3'-carboxypropylamino)-1,3,5-triazine, 2,4,6-tris(2'-carboxyethylamino)-1,3,5-triazine, 2,4,6-tris(4'-carboxybutylamino)1,3,5-triazine, 2,4,6-tris(11'-carboxyundecylamino)-1,3,5-triazine, 2,4,6-tris(5'-carboxypentyl-N-methylamino)-1,3,5-triazine, 2,4,6-tris(carboxymethyl-N-methylamino)-1,3,5-triazine, 2,4,6-tris(3'-carboxypropyl-N-methylamino)-1,3,5-triazine, 2,4-bis(5'-carboxypentylamino)-6-ethylamino-1,3,5-triazine, 2,4-bis(5'-carboxypentylamino)-6-n-octylamino-1,3,5-triazine, 2,4-bis(5'-carboxypentylamino)-6-cyclohexylamino-1,3,5-triazine, 2,4-bis(5'-carboxypentylamino)-6-diethylamino-1,3,5-triazine, 2,4-bis(5'-carboxypentylamino)-6-(2"-hydroxyethylamino)-1,3,5-triazine, 2,4-bis(2'-carboxyethylamino)-6-n-octylamino-1,3,5-triazine, 2,4-bis(2'-carboxyethylamino)-6-diethylamino-1,3,5-triazine, 2,4-bis(2'-carboxyethylamino)-6 -butylamino-1,3,5-triazine, 2,4-bis(2'-carboxyethylamino)-6-ethylamino-1,3,5-triazine, 2,4-bis(5'-carboxypentylamino)-6-anilino-1,3,5-triazine, 2,4-bis(3'-carboxypropylamino)-6-ethylamino-1,3,5-triazine, 2,4-bis(3'-carboxypropylamino)-6 -n-octylamino-1,3,5-triazine, 2,4-bis(3'-carboxypropylamino)-6-n-propylamino-1,3,5-triazine, 2,4-bis(carboxymethyl)-6-n-octylamino-1,3,5-triazine, 2,4-bis(carboxymethyl)-6-cyclohexylamino-1,3,5 -triazine, 2,4-bis(carboxymethyl)-6-dodecylamino-1,3,5-triazine, 2,4-bis(5'-carboxypentyl-n-methylamino)-6-ethylamino-1,3,5-triazine, 2,4-bis(3'-carboxypropyl-N-methylamino)-6-n-octylamino-1,3,5-triazine, 2,4-bis(carboxymethyl-N-methylamino)-6-n-octylamino-1,3,5-triazine, 2,4-bis(2'-carboxyethyl-N-methylamino)- 6-n-octylamino-1,3,5-triazine, 2,4-bis(5'-carboxypentylamino)-6-(2"-carboxyethylamino)-1,3,5-triazine, 2,4-bis(5'-carboxypentylamino)-6-(carboxymethylamino)-1,3,5-triazine, 2,4-bis(3'-carboxypropylamino)-6-(2"-carboxyethylamino)-1,3,5-triazine, 2,4-bis(2'-carboxyethylamino)-6-(5"-carboxypentylamino)-1,3,5-triazine, 2,4-bis(3'-carboxypropylamino)-6-(5"-carboxypentylamino)-1,3,5-triazine, 2,4-bis(5'-carboxypentylamino)-6-methoxy-1,3,5-triazine, 2,4-bis(2'-carboxyethylamino)-6-butylthio-1,3,5-triazine, 2,4-bis(2'-carboxypentylamino)-6 -n-octyloxy-1,3,5-triazine, 2,4-bis(3'-carboxypropylamino)-6-n-dodecylthio-1,3,5-triazine, 2,4-bis(5'-carboxyethylamino)-6-phenyoxy-1,3,5-triazine, 2,4-bis(5'-carboxypentylamino)-6-methylthio-1,3,5-triazine, 2,4-bis(5'-carboxypentylamino)-6 -ethoxy-1,3,5-triazine, and salts of these acids.

The compounds of formula II are disclosed as corrosion inhibitors for aqueous systems in EP-A-129 506. Their preparation is also described in this reference.

Representative examples of individual compounds of formula II are benzothiazol-2-ylthiosuccinic acid, 5-methylbenzothiazol-2-ylthiosuccinic acid, 6-ethylbenzothiazol-2-ylthiosuccinic acid, 4-isopropylbenzothiazol-2-ylthiosuccinic acid, 7-tert-butyl-benzothiazol-2-ylthiosuccinic acid, 6-methoxybenzothiazol-2-ylthiosuccinic acid, 7-ethoxybenzothiazol-2-ylthiosuccinic acid, 4-fluorobenzothiazol-2-ylthiosuccinic acid, 5-chlorobenzothiazol-2-ylthiosuccinic acid, 7-bromobenzothiazol-2-ylthiosuccinic acid, 6-chlorobenzothiazol-2-ylthiosuccinic acid, 6-nitrobenzothiazol-2-ylthiosuccinic acid, 5-carboxybenzothiazol-2-ylthiosuccinic acid, 6-aminobenzothiazol-2-ylthiosuccinic acid, 1-(benzothiazol-2-ylthio)propane-1,2-dicarboxylic acid, 3-(benzothiazol-2-ylthio)propane-1,2-dicarboxylic acid, 3-(6-aminobenzthiazol-2-yl)propane- 1,2-dicarboxylic acid, 1-(benzothiazol-2-ylthio)propane-1,3-dicarboxylic acid, 2-(benzothiazol-2-ylthio)propane-1,3-dicarboxylic acid, 2-(benzothiazol-2-ylthio)butane-2,3-dicarboxylic acid, 1-(benzothiazol-2-ylthio)butane-2,4-dicarboxylic acid, 4-(benzothiazol-2-ylthio)butane-1,2,3-tricarboxylic acid, 1-benzothiazol-2-ylthio)hexane- 1,6-dicarboxylic acid, 1-(benzothiazol-2-ylthio)propane-1,2,3-tricarboxylic acid, 1-(benzthiazol-2-ylthio)-3-hydroxypropane- 1,2-dicarboxylic acid, 1-(benzothiazol-2-ylthio)-2-phenylsuccinic acid, 1-(benzothiazol-2-ylthio)-2-benzylsuccinic acid, benzoxazol-2-ylthiosuccinic acid, 5-methylbenzoxazol-2-ylthiosuccinic acid, 4-isopropylbenzoxazol-2-ylthiosuccinic acid, 6-ethoxybenzoxazol-2-ylthiosuccinic acid, 5-chlorobenzoxazol-2-ylthiosuccinic acid, 5-carboxybenzoxazol-2-ylthiosuccinic acid, 6-aminobenzoxazol-2-ylthiosuccinic acid, 1-(benzoxazol-2-ylthio)propane-1,2-dicarboxylic acid, 3-(benzoxazol-2-ylthio)propane-1,2-dicarboxylic acid, 2-(benzoxazol-2-ylthio)propane-1,3-dicarboxylic acid, 2-(benzoxazol-2-ylthio)butane-2,3-dicarboxylic acid, 1-(benzoxazol-2-ylthio)propane-1,2,3-tricarboxylic acid, benzimidazol-2-ylthiosuccinic acid, 1-(benzimidazol-2-ylthio)propane-1,2-dicarboxylic acid, 3-(benzimidazol-2-ylthio)propane-1,2-dicarboxylic acid, 1-(benzimidazol-2-ylthio)propane-1,3-dicarboxylic acid, 1-(benzimidazol-2-ylthio)butane-1,2 -dicarboxylic acid, 4-(benzimidazol-2-ylthio)butane-1,2,3-dicarboxylic acid, 2-(benzimidazol-2-ylthio)butane-2,3-dicarboxylic acid, 1-(benzimidazol-2-ylthio)propane-1,2,3 -tricarboxylic acid, 1-(benzimidazol-2-ylthio)phenylsuccinic acid, and salts of these acids.

The compounds of formula III are known compounds which are commercially available and are suitable for different utilities.

Typical individual compounds of formula III are succinic acid, glutaric acid, adipic acid, suberic acid, azelaic acid, sebacid acid or decane-1,10-dicarboxylic acid, and the salts, preferably the sodium salts, thereof.

A particularly preferred polycarboxylic acid corrosion inhibitor is 2,4,6-tris(5-carboxypentylamino)-1,3,5-triazine or benzothiazol-2-ylthiosuccinic acid.

In a preferred embodiment of the invention, the corrosion inhibitor can contain 10–50%, preferably 20–40%, of anthranilic acid.

Suitable dispersants are all surface-active compounds, preferably anionic and nonionic surfactants.

Exemplary of eligible dispersants are the following compound classes:

1. Anionic surfactants 1.1 Condensates of aromatic sulfonic acids with formaldehyde, suitably condensates of formaldehyde and naphthalenesulfonic acids or of formaldehyde, naphthalenesulfonic acid and benzenesulfonic acid, or a condensate of crude cesol, formaldehyde and naphthalenesulfonic acid.

1.2 Ligninsulfonates, typically those obtained by the sulfite or kraft process. Preferably these are products some of which are hydrolysed, oxidised or desulfonated and fractionated by known processes, for example according to molecular weight or the degree of sulfonation. Mixtures of sulfite and kraft-ligninsulfonates are very effective.

1.3 Dialkylsulfosuccinates in which the alkyl moieties are branched or unbranched, typically dipropyl sulfosuccinate, diisobutyl sulfosuccinate, diamyl sulfosuccinate, bis(2-ethylhexyl) sulfosuccinate or dioctyl sulfosuccinate.

1.4 Sulfated or sulfonated fatty acids or fatty acid esters of fatty acids, including sulfated oleic acid, elaidic acid or ricinolic acid and the lower alkyl esters thereof, typically the ethyl, propyl or butyl esters. Also very suitable are the corresponding sulfated or sulfonated oils, such as olive oil, colza oil and, preferably, castor oil.

1.5 Reaction products of ethylene oxide and/or propylene oxide with saturated or unsaturated fatty acids, fatty alcohols, fatty amines, alicyclic alcohols or aliphatic-aromatic hydrocarbons which are esterified in the terminal position by an inorganic oxygen-containing acid or a polybasic carboxylic acid. Such compounds are preferably compounds of formula $$R—A—(CH_2C_2HO)_p—Q$$

wherein R is an aliphatic hydrocarbon radical of 8 to 22 carbon atoms or a cycloaliphatic or an aliphatic-aromatic hydrocarbon radical of 10 to 22 carbon atoms, A is —O—, —NH— or —CO—O—, Q is the acid radical of an inorganic, polybasic acid or the radical of a polybasic carboxylic acid and p is a number from 1 to 20, preferably from 1 to 5. The radical R—A— is derived from a higher alcohol, as from decyl alcohol, lauryl alcohol, tridecyl alcohol, myristyl alcohol, cetyl alcohol, stearyl alcohol, oleyl alcohol, arachidyl alcohol, hydroabietyl alcohol or behenyl alcohol; and also from a fatty amine such as stearylamine, palmitylamine or oleylamine; from a fatty acid, as from caprylic acid, capric acid, lauric acid, myristic acid, palmitic acid, stearic acid, arachidic acid, behenic acid, coconut fatty ($C_8$–$C_{18}$)acid, decenoic acid, dodecenoic acid, tetradecenoic acid, hexadecenoic acid, oleic acid, linolic acid, linolenic acid, eicosenoic acid, docosenoic acid or clupanodonic acid; or from an alkyl phenol, as from butyl phenol, hexyl phenol, n-octyl phenol, n-nonyl phenol, p-tert-octyl phenol, p-tert-nonyl phenol, decyl phenol, dedecyl phenol, tetradecyl phenol or hexadecyl phenol.

The acid radical Q is normally derived from a lower dicarboxylic acid, as from maleic acid, malonic acid, succinic acid or sulfosuccinic acid, and is linked through a ester bridge to the radical R—A—$(CH_2CH_2O)_p$—. Preferably, however, Q is derived from an inorganic polybasic acid such as orthophosphoric acid or sulfuric acid. The acid radical Q is preferably in salt form, i.e. as alkali metal salt, allmonium salt or amine salt. Exemplary of such salts are sodium, potassium, ammonium, trimethylamine, ethanolamine, diethanolamine or triethanolamine salts.

The anionic dispersants are normally in the form of their alkali metal salts, their ammonium salts or their water-soluble amine salts. Dispersants with a low electrolyte content will preferably be used.

2. Nonionic surfactants.

Ethylene oxide adducts of the class of the polyadducts of ethylene oxide with higher fatty acids, saturated or unsaturated fatty alcohols, mercaptans, fatty acid amides, fatty acid alkylolamides or fatty amines, or with alkyl phenols or alkylthiophenols, which polyadducts preferably contain 5 to 100 mol of ethylene oxide per 1 mol of the cited compounds, as well as ethylene oxide-propylene oxide block polymers and polyadducts of ethylenediamine-ethylene oxide-propylene oxide. Such nonionic surfactants include:

2.1 reaction products of saturated and/or unsaturated fatty alcohols of 8 to 20 carbon atoms, containing 20 to 100 mol of ethylene oxide per mol of alcohol, preferably saturated linear $C_{16}$–$C_{18}$alcohols containing 25 to 80 mol, preferably 25 mol, of ethylene oxide per mol of alcohol;

2.2 reaction products of saturated and/or unsaturated fatty acids of 8 to 20 carbon atoms containing 5 to 20 mol of ethylene oxide per mol of acid;

2.3 reaction products of $C_7$–$C_{12}$alkyl phenols with 5 to 25 mol of ethylene oxide per mol of phenolic hydroxy group, preferably reaction products of mono- or dialkyl phenols containing 10 to 20 mol of ethylene oxide per mol of phenolic hydroxyl group;

2.4 reaction products of saturated and/or unsaturated fatty acid amides containing up to 20 carbon atoms with 5 to 20 mol of ethylene oxide per mol of acid amide, preferably oleylamides containing 8 to 15 mol of ethylene oxide per mol of acid amide.

2.5 reaction products of saturated and/or unsaturated fatty acid amines containing up to 8 to 20 carbon atoms with 5 to 20 mol of ethylene oxide per mol of amine, preferably oleylamines containing 8 to 15 mol of ethylene oxide per mol of amine;

2.6 ethylene oxide-propylene oxide block polymers containing 10–80% of ethylene oxide and having molecular weights of 1000–80,000;

2.7 polyadducts of ethylene oxide-propylene oxide with ethylenediamine;

3. Copolymers of synthetic monomers, preferably of monomers containing carboxyl groups, suitably copolymers of 2-vinylpyrrolidone with 3-vinylpropionic acid or maleic acid copolymers and salts thereof.

The thickeners stabilise the dispersions, so that they may also be termed stabilisers. Typical stabilisers which may suitably be used are preferably modified polysaccharides of the xanthane, alginate, guar or cellulose type. These thickeners include cellulose ethers, typically methyl cellulose or carboxylmethyl cellulose, or heteropolysaccharides which contain mannose or glucuronic acid groups in the side-chains. Such thickeners are commercially available.

Aside from the dispersant and the thickener, the novel dispersions can contain further modifiers, including hydrotropic agents such as urea or sodium xylenesulfonate; antifreeze agents, typically ethylene or propylene glycol, diethylene glycol, glycerol or sorbitol; humectants such as polyethylene glycols or glycerol; biocides such as chloroacetamide, formalin or 1,2-benzisothiazolin-3-one; or chelating agents such as trisodium nitrilotriacetate.

The addition of biocides, preferably of fungicides, for preventing fungal growth in the aqueous dispersions, is of particular importance. The biocide is preferably added in an amount of 0.05 to 0.5% by weight, based on the dispersion.

To prepare these dispersions it is expedient to start from the moist filter cake to which are added the dispersant and the thickener and, if required, the desired amount of water and other optional additives. The mixture is then stirred until a flowable homogeneous dispersion is obtained.

If the filter cake already contains the desired amount of water, then naturally no water will be added. During filtration, the polycarboxylic acid can be squeezed out such that the residual water content of the filter cake is only 40% or less. Water is then slowly added to the stirred filter cake in an amount sufficient to give a flowable dispersion. Once the optimum amount of water has been determined, the pressure during filtration can be so chosen that the filter cake will have the desired water content.

Stirring can be effected in customary mixing apparatus, preferably in mixers in which the material to be stirred is subjected to strong pressure. Useful mixers are typically spindle mills, tooth mills, colloid mills or screw-type mixers.

Depending on the type of mixer employed, the time required for obtaining a flowable dispersion is from about half an hour to one hour. Stirring is preferably carried out at room temperature, but in certain cases it can be advantageous to cool the stirred material slightly.

The dispersions so obtained are stable for several months at room temperature as well as in the temperature range up to 40° C. They retain their flow properties and do not dehomogenise. This is an important property for the storage and transportation of the dispersions.

Fur using the dispersions in aqueous media it is advantageous that the dispersions can be handled as fluids and pumped for metered addition. Another advantage is that the dispersions dissolve very rapidly in alkaline-aqueous systems. If the dispersions consist of the salts of polycarboxylic acids, then they also dissolve in neutral aqueous systems. Dissolution can also be accelerated by stirring.

Exemplary of aqueous systems in which the novel dispersions can be used are cooling water systems, air conditioning plants, stem generating plants, seawater desalination plants, heating and cooling water systems, aqueous hydraulic fluids, and, most particularly, aqueous machining fluids.

The invention is illustrated by the following non-limitative Examples in which parts and percentages are by weight.

EXAMPLE 1

99.2parts of a filter cake of 2,4,6-tris(5-carboxypentylamino)- 1,3,5-triazine (Reocor® 190, Ciba-Geigy AG), containing 50% of water, are stirred in a turbine mixer (Polytron) at a stirring rate of 1000 rpm until a flowable consistency is obtained. The time taken is c. 15 minutes. Then 0.5 part of a dispersant based on a 40% aqueous solution of sodium dinaphthylmethanedisulfonate (Dispersant CC, Ciba-Geigy AG) is added. After stirring for a further 15 minutes, 0.1 part of a polysaccharide thickener of the xanthane type (Rhodopol® 23, Rhone-Poulenc) and 0.2 part of biocide in the form of a 35% aqueous dispersion of 1,2-benzisothiazolin-3-one (Proxel® BD, JCJ Ltd.) are added and stirring is continued for another 15 minutes. The resultant dispersion contains c. 50% of water and has a viscosity of 170 mPa.s$^{-1}$ at 20° C. (measured on a rotary viscosimeter with a DIN 25 measuring system). For stability testing, the dispersion is stored at room temperature and at 40° C. No phase separation occurs after 6 weeks.

EXAMPLE 2

The procedeure of Example 1 is repeated. 90.6 parts of a Reocor® 190 filter cake (water content: 50%) are stirred with 1 part of an anionic surfactant based on a condensate of formaldehyde with an aromatic sulfonic acid in the form of a 10% aqueous solution (Dispersant H, Ciba-Geigy AG), 0.2 part of Rhodopol® 23 and 0.2 part of Proxel® BD. The resultant dispersion has a viscosity of 250 mPa.s$^{-1}$ and shows no change after storage for 4 months at 20° C.

EXAMPLE 3

The procedure of Example 1 is repeated, mixing the following components:

99. 1 parts of Reocor® 190 filter cake (50% water content)

0.5 part of an ethylene oxide-propylene oxide block copolymer (Pluronic® F 108, BASF-Wyandotte Corp.) as dispersant 0.2 part of Rhodopol® 23 as thickener 0.2 part of Proxel® BD as biocide The resultant dispersion has a viscosity of 250 mPa/s.

EXAMPLES 4–8

The procedure of Example 1 is repeated, varying the dispersant and the amount of the composition.

All dispersions are storage stable for 4 months at 20° C.

EXAMPLE 9

5 kg of a filter cake of benzothiazol-2-ylthiosuccinic acid (Reocor® 152, Ciba-Geigy AG), containing 54% of water, are dispersed with 25 g of Dispersant CC and 5 g of Rhodopol® 23 as described in Example 1. The dispersion has a viscosity of 60 mPa$^{-1}$ at 25° C. (measured with a viscotester VT 500 at a rotation of 8). At room temperature this dispersion shows no change after storage for 6 weeks.

EXAMPLE 10

3 g of a ligninsulfonate (Reax® 85-A) are dissolved in 44 g of water in a 1.5 liter glass vessel with stainless steel screw stirrer. Then 900 g of a filter cake of Reocor® 190 containing c. 50% of water are added over 15 minutes at a stirring rate of c. 50–70 rpm to give a fluid dispersion which is homogenised for c. 30 minutes at 50–70 rpm. Then a solution of 1 g of Rhodopol® 23 in 50 g of water is added and the dispersion is thereafter stirred for 1 hour at 75 rpm. The dispersion so obtained has a viscosity of 200 mPa.s$^{-1}$ (at 25° C.). It contains 45% of the corrosion inhibitor, 54.5% of water, 0.3% of dispersant, and 0.1% of thickener.

EXAMPLE 11

800 g of a filter cake of Reocor® 190 containing c. 50% of water are added over 15 minutes at a stirring rate of c. 50–60rpm to a solution of 10 g of Dispersant CC and 2 g of polyethylene oxide (MG $10^6$) in 135 g of water. Then a solution of 1 g of Rhodopol® 23 in 50 g of water and 2 g of Proxel® BD are added. The dispersion is then homogenised for 1 h at 75 rpm to give a flowable dispersion containing 40% of the corrosion inhibitor, 59% of water, 0.4% of dispersant, 0.1% of thickener, 0.2% of biocide and 0.2% of lubricant (polyethylene oxide).

EXAMPLE 12

1.2 g of a ligninsulfonate (Reax® 85-A) are dissolved in 91 g of water in a 600 ml glass vessel with stainless steel screw stirrer. Then 256 g of a filter cake of Reocor® 190 containing c. 50% of water are added over 15 minutes at a stirring rate of c. 50–70 rpm. Then 32 g of anthranilic acid are added over 15 minutes to the fluid dispersion, which is thereafter homogenised for 30 minutes at 50–70 rpm. Then a solution of 0.4 g of Rhodopol® 23 in 19.6 g of water is added and the dispersion is stirred for 1 hour at 75 rpm. The dispersion so obtained has a viscosity of 200 mPa.s$^{-1}$ (at 25° C.). It contains 40% of the corrosion inhibitor (ratio of 80 parts of Reocor 190 and 20 parts of anthranilic acid); 59.6% of water, 0.3% of dispersant and 0.1% of thickener.

| Example | Dispersant | Thickener | Biocide | Viscosity mPa/s |
|---|---|---|---|---|
| 4 | 0.5% of Dispersant CC | 0.1% of Rhodopol ® 23 | 0.2% of Proxel BD | 170 |
| 5 | 0.5% of Dispersant CC | 0.2% of Rhodopol ® 23 | 0.2% of Proxel | 200 |
| 6 | 1% of Dispersant CC | 0.2% of Rhodopol ® 23 | 0.2% of Proxel BD | 400 |
| 7 | 1% of Dispersant H | 0.2% of Rhodopol ® 23 | 0.2% of Proxel BD | 250 |
| 8 | 2% of Dispersant H | 0.2% of Rhodopol ® 23 | 0.2% of Proxel BD | 500 |

EXAMPLE 13

1.2 g of a ligninsulfonate (Reax® 85-A) are dissolved in 123 g of water in a 600 ml glass vessel with stainless steel screw stirrer. Then 192 g of a filter cake of Reocor® 190 containing c. 50% of water are added over 15 minutes at a stirring rate of c. 50–70 rpm. Then 64 g of anthranilic acid (99%) are added over 15 minutes to the fluid dispersion, which is thereafter homogenised for 30 minutes at 50–70 rpm. Then a solution of 0.4 g of Rhodopol® 23 in 19.6 g of water is added and the dispersion is stirred for 1 hour at 75 rpm. The dispersion so obtained has a viscosity of 200 $mPa.s^{-1}$ (at 25° C.). It contains 40% of the corrosion inhibitor (ratio of 60 parts of Reocor 190 and 40 parts of anthranilic acid); 59.6% of water;, 0.3% of dispersant and 0.1% of thickener.

EXAMPLE 14

1.2 g of a ligninsulfonate (Reax® 85-A) are dissolved in 19 g of water in a 600 ml glass vessel with stainless steel screw stirrer. Then 360 g of a filter cake of Reocor® 190 (monosodium salt*) containing c. 50% of water are added over 15 minutes at a stirring rate of c. 50–70 rpm to give a liquid dispersion, which is thereafter homogenised for 30 minutes at 50–70 rpm. Then a solution of 0.4 g of Rhodopol® 23 in 19.6 g of water is added and the dispersion is stirred for 1 hour at 75 rpm. The dispersion so obtained has a viscosity of 200 $mPa.s^{-1}$ (at 25° C.). It contains 45% of the corrosion inhibitor, 54.6% of water; 0.3% of dispersant and 0.1% of thickener.

*) A solution of disodium hydrogen phosphate is added to an aqueous suspension of a filter cake of Reocor 190. The monosodium salt is isolated and can be liquified with Reax dispersant.

EXAMPLE 15

1.2 g of a ligninsulfonate (Reax® 85-A) are dissolved in 19 g of water in a 600 ml glass vessel with stainless steel screw stirrer. Then 360 g of a filter cake of Reocor® 190 (monodiethanolamine salt#) containing c. 50% of water are added over 15 minutes at a stirring rate of c. 50–70 rpm to give a liquid dispersion, which is thereafter homogenised for 30 minutes at 50–70 rpm. Then a solution of 0.4 g of Rhodopol® 23 in 19.6 g of water is added and the dispersion is stirred for 1 hour at 75 rpm. The dispersion so obtained contains 45% of the corrosion inhibitor, 54.6% of water, 0.3% of dispersant and 0.1% of thickener.

#) The stoichiometric amount of diethanolamine is added to an aqueous suspension of a filter cake of Reocor 190. The monodiethanolamine salt is isolated and can be liquified with Reax dispersant.

What is claimed is:

1. A storage-stable, flowable aqueous dispersion of a solid polycarboxylic acid corrosion inhibitor comprising 25–57% by weight of a solid polycarboxylic acid corrosion inhibitor of formula I or II

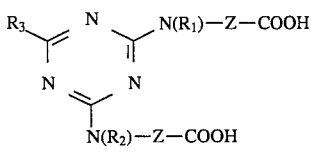

I

-continued

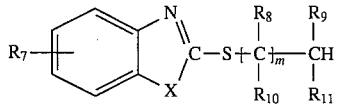

II wherein

Z is $C_1$–$C_{11}$alkylene, cyclohexylene or phenylene, $R_1$ and $R_2$ are each independently of the other H, $C_1$–$C_4$alkyl or a group —Z—COOH, $R_3$ is $C_1$–$C_{12}$alkyl, phenyl or a group —N($R_4$)($R_5$), —O$R_6$ or —S$R_6$, $R_4$ and $R_5$ are each independently of the other H, $C_1$–$C_{12}$alkyl, $C_2$–$C_4$ hydroxyalkyl, cyclohexyl, phenyl or a group —Z—COOH, or $R_4$ and $R_5$, when taken together, are $C_4$–$C_6$alkylene or 3-oxapentylene, $R_6$ is hydrogen, $C_1$–$C_{12}$alkyl or phenyl, m is 0 or 1, X is sulfur, oxygen or NH, $R_7$ is hydrogen, $C_1$–$C_4$alkyl, halogen, $C_1$–$C_4$alkoxy, carboxy, amino or nitro, $R_8$, $R_9$, $R_{10}$ and $R_{11}$ are each independently of one another hydrogen, $C_1$–$C_{12}$alkyl, $C_1$–$C_4$hydroxyalkyl, $C_2$–$C_6$carboxyalkyl, $C_2$–$C_{10}$alkoxyalkyl, carboxyl, phenyl or benzyl, or $R_8$ and $R_9$, when taken together, are a direct bond, with the proviso that at least two of the groups $R_8$, $R_9$, $R_{10}$ and $R_{11}$ are a carboxyl or carboxylalkyl group, or an alkali metal salt, ammonium salt or amine salt, of such solid polycarboxylic acid corrosion inhibitor of formula I or II, 40–72% by weight of water, 0.1–2% by weight of a dispersant and 0.01 to 0.5% by weight of a thickener.

2. A dispersion according to claim 1, wherein Z is $C_1$–$C_8$alkylene, $R_1$ and $R_2$ are hydrogen or $C_1$–$C_4$alkyl, $R_3$ is a group —N($R_4$)($R_5$), $R_4$ is hydrogen, cyclohexyl or $C_1$–$C_{12}$alkyl, $R_5$ is $C_1$–$C_{12}$alkyl, phenyl or a group —Z—COOH, or $R_4$ and $R_5$, when taken together, are 1,5-pentylene or 3-oxa-1,5-pentylene, m is 0 or 1, X is sulfur, $R_7$ is hydrogen, methyl or chloro, $R_8$ and $R_{10}$ are hydrogen, and $R_9$ and $R_{11}$ are carboxyl or $C_2$–$C_4$carboxyalkyl.

3. A dispersion according to claim 1, wherein Z is pentamethylene, $R_1$ and $R_2$ are hydrogen, $R_3$ is a group —NH—$(CH_2)_5$—COOH, X is sulfur, $R_7$ is hydrogen, m is 0 or 1, $R_8$ and $R_{10}$ are hydrogen, $R_9$ is carboxyl and $R_{11}$ is carboxymethyl.

4. A dispersion according to claim 1, wherein the polycarboxylic acid corrosion inhibitor is 2,4,6-tris(5-carboxypentylamino)-1,3,5-triazine or benzothiazol-2-yl-thiosuccinic acid.

5. A dispersion according to claim 1 comprising 40–53% of a formula I or II, 45–58% of water, 0.1 to 2% of a dispersant and 0.01 to 0.5% of a thickener.

6. A dispersion according to claim 1, wherein the dispersant is an anionic or nonionic surfactant.

7. A dispersion according to claim 6, wherein the thickener is a modified polysaccharide.

8. A dispersion according to claim 1, which additionally comprises 0.05 to 0.5% by weight of a biocide.

9. A dispersion according to claim 8, wherein the biocide is a fungicide.

10. A dispersion according to claim 1, which comprises as additional corrosion inhibitor 10–50% by weight, based on the total weight of corrosion inhibitors, of anthranilic acid.

11. A dispersion according to claim 1, which comprises as additional corrosion inhibitor 20–40% by weight, based on the total weight of corrosion inhibitors, of anthranilic acid.

12. A process for the preparation of a flowable aqueous dispersion of a polycarboxylic acid corrosion inhibitor of the formula I or II according to claim 1, comprising 25–57% of the corrosion inhibitor, 40–72% of water, 0.1–2% of a dispersant and 0.01 to 0.5% of a thickener, which process comprises mixing a moist corrosion inhibitor, obtained by filtration, with the dispersant and the thickener and stirring the mixture until it is flowable.

13. A process according to claim 12, wherein the stirring is carried out at room temperature.

* * * * *